US007371980B2

(12) United States Patent
Marshall

(10) Patent No.: US 7,371,980 B2
(45) Date of Patent: May 13, 2008

(54) APPARATUS AND METHODS FOR SECURING SWITCH DEVICES

(75) Inventor: Christopher R. Marshall, Rockwall, TX (US)

(73) Assignee: L 3 Communication Integrated Systems LP, Greenville, TX (US)

( * ) Notice: Subject to any disclaimer, the term of this patent is extended or adjusted under 35 U.S.C. 154(b) by 16 days.

(21) Appl. No.: 11/250,688

(22) Filed: Oct. 14, 2005

(65) Prior Publication Data

US 2007/0084705 A1 Apr. 19, 2007

(51) Int. Cl.
*H01H 9/28* (2006.01)

(52) U.S. Cl. ..... 200/43.11; 200/43.14

(58) Field of Classification Search ..... 200/43.14, 200/43.15, 43.19, 43.21, 329–332
See application file for complete search history.

(56) References Cited

U.S. PATENT DOCUMENTS

| | | | | | |
|---|---|---|---|---|---|
| 1,917,620 | A | * | 7/1933 | Van Sickel | 70/252 |
| 2,807,692 | A | * | 9/1957 | Leslie | 200/333 |
| 3,527,914 | A | * | 9/1970 | Spacek | 200/43.19 |
| 4,367,386 | A | * | 1/1983 | Sorenson | 200/333 |
| 4,723,458 | A | * | 2/1988 | Blok | 74/471 XY |
| 5,060,107 | A | * | 10/1991 | Castonguay | 361/115 |
| 5,122,624 | A | * | 6/1992 | Benda | 200/43.14 |
| 5,165,528 | A | | 11/1992 | Kozlowski et al. | |
| 5,207,315 | A | * | 5/1993 | Benda | 200/43.11 |
| 5,300,740 | A | * | 4/1994 | Benda | 200/43.14 |
| 5,310,969 | A | | 5/1994 | Turek et al. | |
| 5,380,968 | A | * | 1/1995 | Morse | 200/302.3 |
| 5,457,295 | A | * | 10/1995 | Tanibe et al. | 200/293 |
| 5,732,815 | A | * | 3/1998 | Brouwer | 200/43.14 |
| 5,868,242 | A | * | 2/1999 | Hall et al. | 200/43.14 |
| 6,310,305 | B1 | * | 10/2001 | Kamino et al. | 200/43.11 |
| 6,365,851 | B1 | * | 4/2002 | Gasper | 200/43.14 |
| 6,392,170 | B1 | * | 5/2002 | Wechsler | 200/43.21 |
| 6,469,264 | B2 | * | 10/2002 | Benda | 200/43.14 |
| 6,617,532 | B1 | * | 9/2003 | Turek | 200/43.14 |
| 6,696,651 | B1 | | 2/2004 | Koopmeiners et al. | |
| 6,727,441 | B2 | | 4/2004 | Benda | |
| 6,930,262 | B2 | * | 8/2005 | Lee | 200/43.17 |
| 6,940,027 | B1 | * | 9/2005 | Sipe | 200/43.14 |
| 2004/0245077 | A1 | | 12/2004 | Benda | |

OTHER PUBLICATIONS

Military Distribution Statement, MS24509, Circuit Breaker-Aircraft, Trip-Free, Toggle, 5 Thru 15 Amp, Type I, Nov. 30, 1987, 5 pgs.

Military Specification, "Panels, Airport Lighting Control, General Specification For", FSC 6210, Dec. 11, 1970, 13 pgs.

(Continued)

*Primary Examiner*—Elvin Enad
*Assistant Examiner*—Lisa Klaus
(74) *Attorney, Agent, or Firm*—O'Keefe, Egan, Peterman & Enders LLP

(57) ABSTRACT

Apparatus and methods for lockout of toggle switches, such as those toggle switches that include a captivating switch head (e.g., an enlarged and/or offset switch head) disposed on a cylindrical-shaped switch arm of the toggle switch. In one example, the apparatus and methods may employ a securement housing configured to be secured to a toggle switch by capturing at least a portion of the switch arm of the toggle switch between a switch head and an adjacent surface in a manner that prevents movement of the switch arm from a first switch position (e.g., "off" position) to a second switch position (e.g., "on" position).

28 Claims, 8 Drawing Sheets

OTHER PUBLICATIONS

Occupational Safety and Health Admin., Labor, 29 CFR Ch XVII, Section 1910.147, Jul. 1, 1999, 470-477.

Texas Instruments, Klixon 7270 and 7271 Series, Single-Phase, Toggle or Pushbutton, http://www.ti.com/snc/products/controls/acb-7270.htm. printed from Internet on Sep. 20, 2005, 6 pgs.

Military Distribution, Air Force Occupational Safety and Health Standard 91-501 (AFOSHSTD91-501), "Air Force Consolidated Occupational Safety Standard", Jul. 7, 2004, pp. 1-10.

Military Electrical Safety Guidelines, AFOSHSTD91-501, "Electrical Safety", Jul. 7, 2004, Chapter 8, pp. 67-75.

Military Hazardous Energy Control Guidelines, AFOSHSTD91-501, Hazardous Energy Control (Lockout and Tagout) and Mishap Prevention Signs and Tags, Jul. 7, 2004; Chapter 21, pp. 277-291.

"Living Hinge", Wikipedia, http://en.wikipedia.org/wiki/Living_hinge, page last modified Jun. 29, 2005, 1 pg.

* cited by examiner

APPARATUS AND METHODS FOR SECURING SWITCH DEVICES

FIELD OF THE INVENTION

This invention relates generally to switch devices, and more particularly to apparatus and methods for securing switch devices.

BACKGROUND OF THE INVENTION

Occupational Health and Safety Administration (OSHA) and Air Force Occupational Safety and Health (AFOSH) regulations require circuit breaker switches to be locked in the OFF position during servicing and/or maintenance of machines and equipment, such as aircraft. These regulations include OSHA standard 1910.147 and AFOSH standard 91-501, and require affixing of appropriate lockout devices to energy isolating devices during servicing and/or maintenance of machines and equipment.

Examples of circuit breaker switches traditionally employed for aircraft electrical systems include push/pull circuit breaker switches that are pulled outward to place the switch in the OFF position. Such push/pull switches may be locked out for servicing or maintenance by using a collar that is configured to be inserted under the push/pull switch to lock the switch in the OFF position by preventing the switch from being pushed in toward the ON position. The lockout collar may be removed following a servicing or maintenance operation so that the circuit breaker switch may then be pushed in to the ON position. Other types of circuit breaker lockout devices include those having a casing member having an opening that may be positioned around a conventional household circuit breaker toggle switch and having a set screw that may be driven into engagement with the circuit breaker toggle switch to secure the switch in the desired position. However, available lock out devices do not work well, if at all, with circuit breaker toggle switches having cylindrical switch arms, such as Military Standard MS24509 circuit breakers and similar circuit breakers having cylindrical switch arms.

SUMMARY OF THE INVENTION

Disclosed herein are apparatus and methods for securing toggle switches, such as those toggle switches that include a captivating switch head (e.g., an enlarged and/or offset switch head) disposed on a cylindrical-shaped switch arm of the toggle switch. In one embodiment, the disclosed apparatus and methods may include a securement housing configured to secure a toggle switch in a first switch position by capturing at least a portion of the switch arm of the toggle switch between a switch head and a surface adjacent to the switch arm (e.g., a base surface of a toggle switch assembly or other adjacent surface disposed adjacent the switch arm) in a manner that prevents movement of the switch arm from the first switch position (e.g., "off" position) to a second switch position (e.g., "on" position).

A securement housing may be configured according to the disclosed apparatus and methods as a single-component or multi-component apparatus. For example, a single component apparatus may be provided in one embodiment that includes a first housing component that is configured to capture and prevent movement of a switch arm from a first switch position (e.g., "off" position) to a second switch position (e.g., "on" position). A multi-component housing may be provided in another embodiment that includes a second housing component configured to cooperatively operate with the first housing component, e.g., for purposes of added stability/security and/or to facilitate operative locked engagement of the securement housing with the switch arm in order to meet OSHA/AFOSH lockout requirements. These requirements include OSHA standard 1910.147 and AFOSH standard 91-501 that require affixing of appropriate lockout devices to energy isolating devices during servicing and/or maintenance of machines and equipment. These requirements may be advantageously met using the disclosed apparatus and methods to lockout MS24509 circuit breakers and similar circuit breakers having cylindrical switch arms.

In the practice of the disclosed apparatus and methods, a single-component or multi-component securement housing may be configured to be deployed so that it internally accepts at least a portion of the switch arm between the switch head and an adjacent surface so that the securement housing cannot be removed from the switch arm over the switch head, i.e., so that the securement housing is trapped between the switch head and the adjacent surface. In one embodiment, a securement housing may be configured with an internal profile that internally accepts at least a portion of the switch arm between the switch head and the adjacent surface with at least a portion of the switch head extending or otherwise being disposed outside the securement housing. In such an embodiment, no projections or other features are required to be present on the securement housing to extend into (or to otherwise be received) within a recess or other feature provided on the toggle switch in order to engage and secure the toggle switch arm with the securement housing.

Although not necessary, a securement housing may be further configured with a multi-component and/or expandable configuration so that the locking housing may be selectably deployed in a first position in which it internally accepts at least a portion of the switch arm between the switch head and the adjacent surface so that the securement housing cannot be removed from the switch arm over the switch head, and so that the multiple components or components of the securement housing cooperatively operate with each other to prevent removal of the securement housing from this engaged relationship with the switch arm while in this first position. Such a multi-component or expandable securement housing may be further configured so that it may be selectably deployed in a second position that allows the securement housing to be removed from engagement with the switch arm, e.g., removed from around the switch arm, removed over the switch head, etc. In one exemplary embodiment, the disclosed apparatus and methods may advantageously be implemented to provide a securement housing that may be secured to a circuit breaker toggle switch without requiring the use of tools and/or secondary retaining or fastening devices (e.g., locking screws, pins, or clamps, etc.) to operatively engage the securement housing (e.g., to operatively engage with the switch arm of a toggle switch) in order to secure the toggle switch.

In one embodiment, a lockout apparatus may be provided that includes a securement housing configured with at least one component section made of a plastic-based material or other suitable material. In another exemplary embodiment, a lockout apparatus may be provided that includes a securement housing configured with at least two components (e.g., as left and right side section components). In either embodiment, at least one component section of a securement housing may be configured with an internal profile (e.g., pocketed groove) that is dimensioned and oriented to conform to and accept at least a portion of the switch arm in a position between a switch head and an adjacent surface.

In another embodiment, such an internal profile may be further optionally configured to frictionally and/or resiliently engage the switch arm of a toggle switch in order to facilitate security and/or ease of installation. For example, a narrowed internal profile of a plastic securement housing (or securement housing made of other suitably substantially resilient material) may be provided in the form of a narrowed throat opening through which the switch arm is inserted and received for installation and that is narrower than the outer dimensions of a switch arm. During insertion of the switch arm through such a narrowed throat opening, the plastic material of the securement housing is substantially resiliently deflected by contact with the switch arm and exerts resilient and frictional forces to hold the switch arm in engagement with the securement housing within the narrowed internal profile of the opening. By further combining such a narrowed throat opening with an enlarged inner open portion of the internal profile (e.g., having dimensions large enough to accept the entire outer dimension of the switch arm without deflection or with less deflection than the narrowed throat opening), a "snap-on" fit may be achieved, e.g., so that the switch arm may be "snapped" through the narrowed throat opening into the enlarged inner open portion of the internal profile.

In one exemplary embodiment, a securement housing may be provided with two side section components that are made of a plastic-based material (e.g., polypropylene, polyethylene, etc.) or other suitable material (e.g., metal, wood, etc.) hingeably coupled by a hinge mechanism (e.g., such as a plastic living hinge or other suitable hinge mechanism). In such an exemplary embodiment, one or both side section components of the securement housing may be configured with an internal profile (e.g., pocketed groove) as described above that is dimensioned and oriented to conform to and accept at least a portion of the switch arm when the two separate side section components are closed around the switch arm of a toggle switch in a position between a switch head and an adjacent surface.

In another exemplary embodiment, an optional latching feature may be further provided on a securement housing. A latching feature may be configured, for example, in any form suitable for securably latching two or more separate components of a securement housing together. For example, in the case of a securement housing that includes two side section components coupled together by a hinge mechanism, complementary latch feature components may be provided on each of the two separate side section components in a position opposite the hinge mechanism in order to latch the two separate side sections of the securement housing together around a switch arm of a toggle switch. Such a latching feature may further optionally configured with an integral locking system (e.g., keyed lock, combination lock, etc.)

In another embodiment, an optional fastening point may be further provided on a securement housing. A fastening point may be configured, for example, in any form suitable for facilitating fastening together of two or more separate components of a securement housing with a fastening device such as a locking device. For example, in the case of a securement housing that includes two side section components coupled together by a hinge mechanism, complementary apertures may be optionally defined in each of two separate side section components of the securement housing so that that the apertures of the two side sections are aligned with each other when the two side sections are closed around a switch arm of a toggle switch so as to form a fastening point for an optional locking device (e.g., combination or keyed padlock; etc.) for meeting lockout requirements, and/or other type of optional fastening device (e.g., pin, seal, tag, etc.).

In one exemplary embodiment, a securement housing for use with a given toggle switch (e.g., a MS24509 circuit breaker toggle switch available from LKD AEROSPACE of Issaquali, Washington and described in Military Distribution Statement, MS524509, "Circuit Breaker-Aircraft, Trip-Free, Toggle, 5 Thru 15 Amp, Type I," Sept. 20, 2005) may be provided that includes a first side section component and a second side section component that are hingeably coupled together at one end by a hinge mechanism. The switch arm of such a toggle switch may have an angle relative to an adjacent surface (e.g., base surface of a toggle switch assembly) when the switch arm is disposed in a first (e.g., "off") position, and the first side section component may be configured with a pocketed groove. The pocketed groove may have one or more internal surfaces configured to define a longitudinal axis of the pocketed groove within the first side section component that is oriented within the first side section component at an angle relative to the adjacent surface that corresponds to, or is substantially the same as, the angle of the switch arm in its first (e.g., "off") position when the first side section component is assembled to the toggle switch in a manner so that the internal profile captures at least a portion of the switch arm of the toggle switch. For example, at least a portion of the internal surface/s of a pocketed groove may be oriented within the first side section component at an angle relative to the adjacent surface that corresponds to, or is substantially the same as, the angle of the switch arm in its first position when the first side section component is assembled to the toggle switch. The pocketed groove may be internally dimensioned so as to be large enough to conform to and accept the outer diameter of the cylindrical switch arm of the toggle switch but at the same time to be smaller than the outer diameter of the switch head of the toggle switch. When so angled and dimensioned, the pocketed groove may be configured to accept the switch arm shaft of the toggle switch when the switch arm is disposed in a given position (e.g, in its "off" position) and at the same time that the first side section component of the securement housing is assembled to the switch arm between the switch head and an adjacent surface.

Once the first side section component of the securement housing is so assembled to the switch arm, then the second side section component of the securement housing may be hingeably brought together with the first side section component about the switch arm to securely capture the switch arm between the first and second side section components and within the pocketed groove of the first side section component. Once the securement housing has been securely fastened in this manner to the shaft of the toggle switch, the toggle may no longer be moved from the captured position. For example, when a securement housing is so employed to capture a toggle switch (e.g., MS24509 circuit breaker toggle switch) in its "off" position, the switch arm of the toggle switch may no longer be moved to the "on" position without first removing the securement housing. In a further exemplary embodiment, a securement housing may be latched in position to capture the switch arm using optional latching feature components that may be provided to mechanically latch the first and second side section components together when they are closed around the switch arm of the toggle switch. Complementary apertures may be additionally or alternatively provided on each of first and second side section components of a securement housing that are aligned to form a fastening point for insertion of a locking device or other fastening device when the first and second side section components are closed around the switch arm of the toggle switch.

The disclosed apparatus and methods may be advantageously employed to secure or secure and lockout toggle-type switch mechanisms of all kinds including, but not limited to, household circuit breaker switches, school circuit breaker switches, light switches, etc.

In one respect, disclosed herein is a switch securement apparatus configured for use with a toggle switch having a switch arm and a switch head, the apparatus including a securement housing having an internal profile defined therein, the internal profile being configured to capture at least a portion of the switch arm of the toggle switch with at least a portion of the switch head of the toggle switch being disposed outside the securement housing.

In another respect, disclosed herein is a switch securement apparatus, including: a first side section component having a pocketed groove defined therein, the pocketed groove being open at opposing ends; and a second side section component hingeably coupled to the first side section component.

In another respect, disclosed herein is a method of securing a switch arm of a toggle switch, the method including positioning an internal profile of a securement housing in relationship to the toggle switch to capture at least a portion of the switch arm of the toggle switch with at least a portion of the switch head of the toggle switch being disposed outside the securement housing.

DESCRIPTION OF ILLUSTRATIVE EMBODIMENTS

Figure 1A:
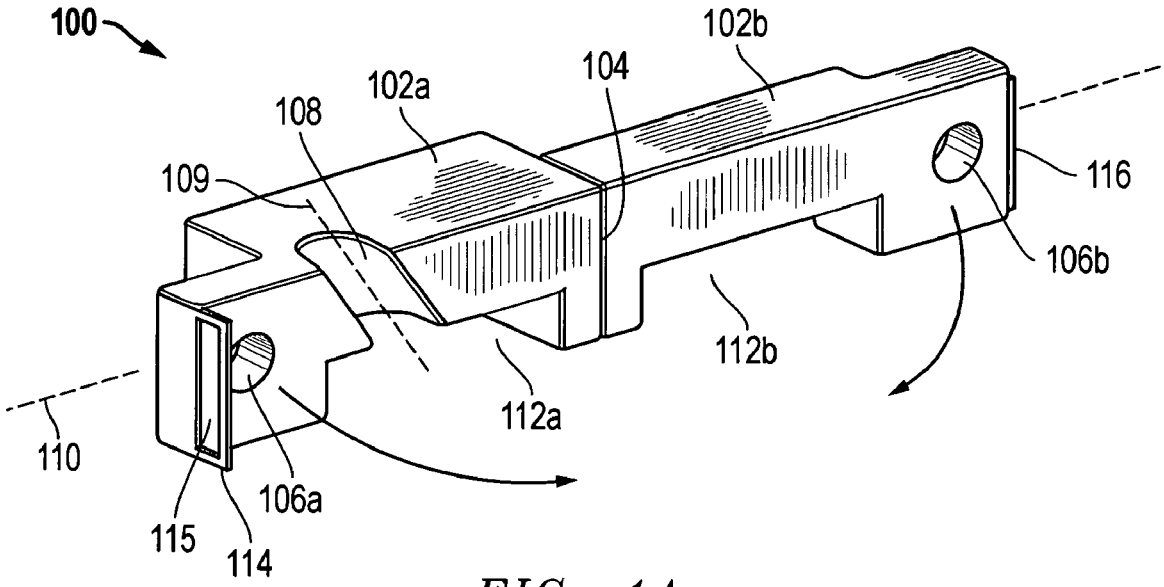
FIG. 1A is a perspective top view of a securement housing configured according to one exemplary embodiment of the disclosed apparatus and methods.

FIG. 1A shows a perspective top view of a securement housing 100 as it may be configured in one exemplary embodiment for lockout of toggle switches such as a MS24509 circuit breaker toggle switch. As shown in FIG. 1A, securement housing 100 includes a first side section component 102*a* and a second side section component 102*b* that are hingeably coupled together at hinge line 104 so that first side section component 102*a* and second side section component 102*b* are capable of rotating about hinge line 104 in the direction shown by the arrows in FIG. 1A. In one exemplary embodiment, multi-component securement housing 100 may be constructed of a single piece of injection molded plastic with an integral living hinge provided for hinge mechanism at hinge line 104 to hingeably couple first and second side section components 102*a* and 102*b*. Such a living hinge may be provided as a thin section of bendable plastic (e.g., polypropylene, polyethylene, etc.) connecting first and second side section components 102*a* and 102*b* at hinge line 104. In FIG. 1A, first and second side section components 102*a* and 102*b* are shown rotated in fully open position relative to each other about hinge line 104.

Besides injection molded plastic, it will be understood that one or more components of a securement housing may be constructed of any other material/s suitable for performing the functions described herein, and that a securement housing may include multiple pieces. Examples of such materials include metals (e.g., machined aluminum or steel), ceramics, wood, etc. Furthermore, any other type of suitable hinge mechanism may be alternatively employed rather than a living hinge. Examples of other suitable types of hinge mechanisms include, but are not limited to, separate metal or plastic hinge components coupled to first and second side section components 102*a* and 102*b* by fasteners (screws, rivets, etc.), etc. It is also possible in another embodiment that first and second side section components of a securement housing may be configured as separate pieces that attach to a toggle switch in a hingeless manner, e.g., as two separate pieces which snap-fit or are otherwise held together around a switch arm.

As shown in FIG. 1A, first side section component 102*a* of securement housing 100 includes an internal profile 108 that is configured in this embodiment as a pocketed groove that is dimensioned and oriented to accept at least a portion of a switch arm of a toggle switch in its "off" position when side section components 102*a* and 102*b* are brought together around the switch arm of the toggle switch in a manner as described and illustrated further herein. In such an embodiment, pocketed groove 108 may have an internal surface configured to define a longitudinal axis 109 that is oriented at an angle of about 56 degrees relative to longitudinal axis 110 of first side section component 102*a*. This angle corresponds to, or is substantially the same as, the angle of the cylindrical switch arm relative to the switch base of a MS24509 circuit breaker when the switch arm is in its "off"

position. It will be understood that a longitudinal axis of an internal profile (e.g., pocketed groove) may be configured with other angles relative to the longitudinal axis of a securement housing component, or may be oriented within a securement housing at any other angle that operationally coincides with the angle of a switch arm in a given position when the securement housing is assembled to a switch device that includes the switch arm. For example, an internal profile (e.g., pocketed groove) may be defined within a securement housing so that it is oriented relative to an adjacent surface (e.g., base surface of a toggle switch assembly) that corresponds to, or is substantially the same as, the angle of a switch arm in a given position in which the switch arm is to be secured when the securement housing is assembled to the toggle switch assembly.

In one exemplary embodiment, pocket groove 108 may be configured with a substantially semi-cylindrical internal diameter of from about 0.170 to about 0.200 inches so as to be large enough to entirely accept the outer diameter (i.e., about 0.165 inches) of a cylindrical switch arm of a MS24509 circuit breaker but which is at the same time smaller than the outer diameter of the switch head of the MS24509 circuit breaker (e.g.,. about 0.305 inches in diameter). As will be described further herein, when so angled and dimensioned, pocketed groove 108 of first side section component 102*a* may be positioned around cylindrical switch arm shaft of a MS24509 circuit breaker when the switch arm is disposed in its "off" position, and first and second side section components 102*a* and 102*b* then brought together around the switch arm at a position between the switch head and a base surface of a toggle switch assembly that includes the MS24509 circuit breaker. As used herein, a "base surface" of a toggle switch assembly refers to any surface/s from which a switch arm of a toggle switch extends including, but not limited to, a surface of the switch device itself (e.g., switch housing, toggle mechanism, etc.), a surface of a switch mounting component (e.g., circuit panel, switch panel, instrument panel, etc.), a surface of hardware for mounting a switch device to a switch mounting component (e.g., threaded nut or other fastening device, etc.), a surface of a switch identification plate or any other component disposed between a switch arm and other components of a switch assembly, etc.

Alternatively, a pocketed groove or other internal profile may be optionally provided that includes an internal surface that is configured to resiliently and/or frictionally engage a cylindrical switch arm shaft of a MS24509 circuit breaker. For example, the internal surface of a pocketed groove or other internal profile may be shaped to have an internal opening, at least a portion of which has dimensions narrower (e.g., width of from about 0.160 inches to about 0.135 inches for cylindrical-shaped switch arm of MS24509 circuit breaker having outer diameter of about 0.165 inches) than the outer diameter of the switch arm so that at least a portion of the outer surface of the switch arm is resiliently and/or frictionally engaged by at least a portion of the inner surface of the pocketed groove in a manner (e.g., snap-on manner) that acts to retain side section component 102*a* on the switch arm. Such a configuration may be provided to facilitate ease of installation, for example, by allowing a first side section component of a securement housing to be snapped on to a switch arm before closing the second side section component of the securement housing around the switch arm, or may be present to securely engage a single side section component to a switch arm.

FIG. 1A also shows first internal base cavity portion 112*a* that is defined within first side section component 102*a* and second internal base cavity portion 112*b* that that is defined within second side section component 102*b*. As further shown, the lower opening of pocketed groove 108 intersects first internal base cavity portion 112*a*. First and second internal base cavities 112*a* and 112*b* may be so provided to accept a toggle mechanism with threaded nut and mounting collar of a MS24509 circuit breaker toggle switch in a manner as described further herein when first and second side section components 102*a* and 102*b* are brought together around a switch arm. Provision of such base cavity portions are optional, but may be employed when the disclosed apparatus and methods are implemented with toggle switches having a raised feature that extends above the base surface of a toggle switch assembly, e.g., such as a toggle mechanism, threaded nut or other feature. Although illustrated as two substantially equal-sized cavities 112*a* and 112*b*, it will be understood that base cavity portions may be configured with any shape and dimension suitable for accepting a raised feature that extends above the base surface of a toggle switch assembly. Examples of alternative configurations include, but are not limited to, a base cavity defined entirely within one side section component of a securement housing. Furthermore, it is also possible that a locking housing may alternatively be configured without a base cavity and to only close around a switch arm whether or not a raised feature extending above the base surface of a toggle switch assembly is present. In the latter case, a securement housing may be closed around a switch arm in a position between the switch head and the raised feature extending above the base surface of the toggle switch assembly.

As further shown in FIG. 1A, securement housing 100 is provided with optional latching feature components in the form of a latch receptacle member 114 provided on first side section component 102*a* and configured to receive and mechanically engage a corresponding latch tab member 116 provided on second side section component 102*b* when first side section component 102*a* is brought together with second side section component 102*b* in a manner to hold first side section component 102*a* and second side section component 102*b* closed together, e.g., around the switch arm of a toggle switch. In this regard, latch receptacle member 114 may be of a resilient material (e.g., plastic) and configured with a latch opening 115 of suitable dimension and shape for receiving latch tab member 116. In such a configuration, latch receptacle member 114 may be configured to resiliently bend and deflect outward upon contact with latch tab member 116 until tab member 116 is received or seated within latch opening 115, at which time latch receptacle member 114 may rebound inwardly so that tab member 116 is captured within latch opening 115 in a manner that secureably latches and holds side section component 102*a* closed together with side section component 102*b*. Latch receptacle member 114 may be deflected outward (e.g., manually deflected by hand) to remove tab member 116 from engagement with latch opening 115 so that side section component 102*a* may be pulled away from side section component 102*b* by rotation about hinge line 104.

FIG. 1A also shows first side section component 102*a* is provided with an optional aperture 106*a* and second side section component 102*b* provided with an optional complementary and mating aperture 106*b* that are positioned so as to come together in aligned relationhip when first side section component 102*a* and second side section component 102*b* are brought together by rotating side section component 102*a* and side section component 102*b* about hinge line 104 in a manner as described elsewhere herein. It will be understood that the optional mating aperatures 106*a* and 106*b* illustrated in FIG. 1A are exemplary only, and that aperatures of other sizes, shapes and location on side section components 102*a* and 102*b* may be alternatively employed.

Figure 1B:
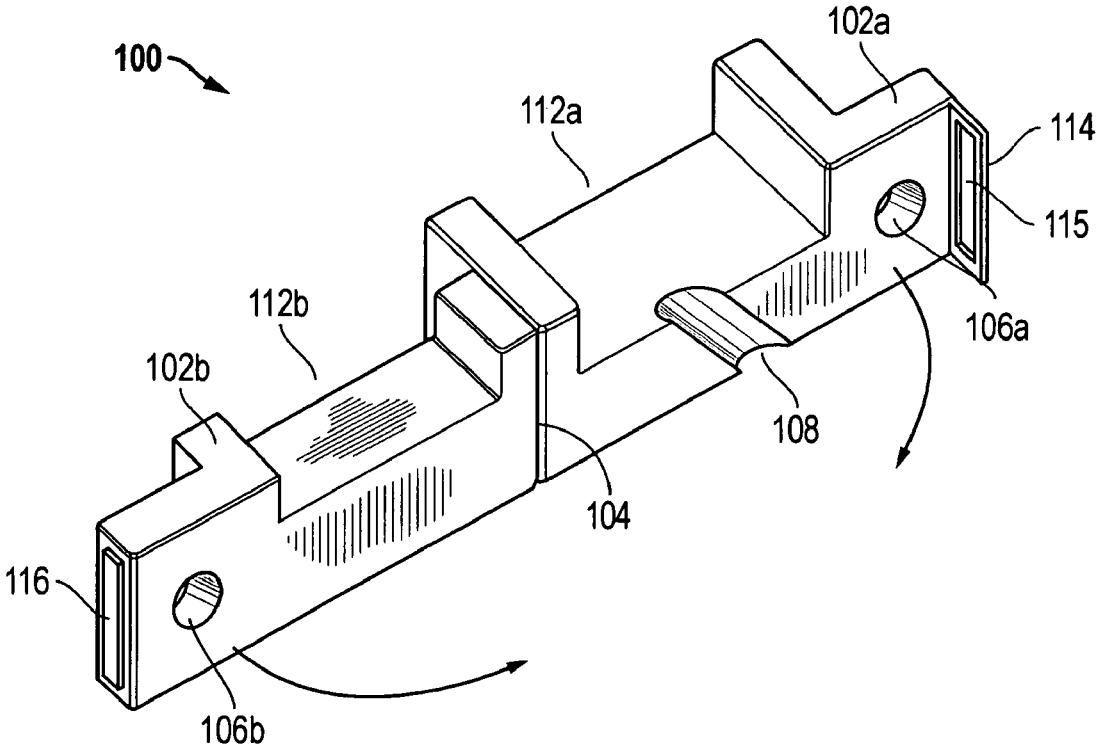
FIG. 1B is a perspective bottom view of a securement housing configured according to one exemplary embodiment of the disclosed apparatus and methods.

FIG. 1B shows a perspective bottom side view of the securement housing 100 of FIG. 1A.

Figure 2:
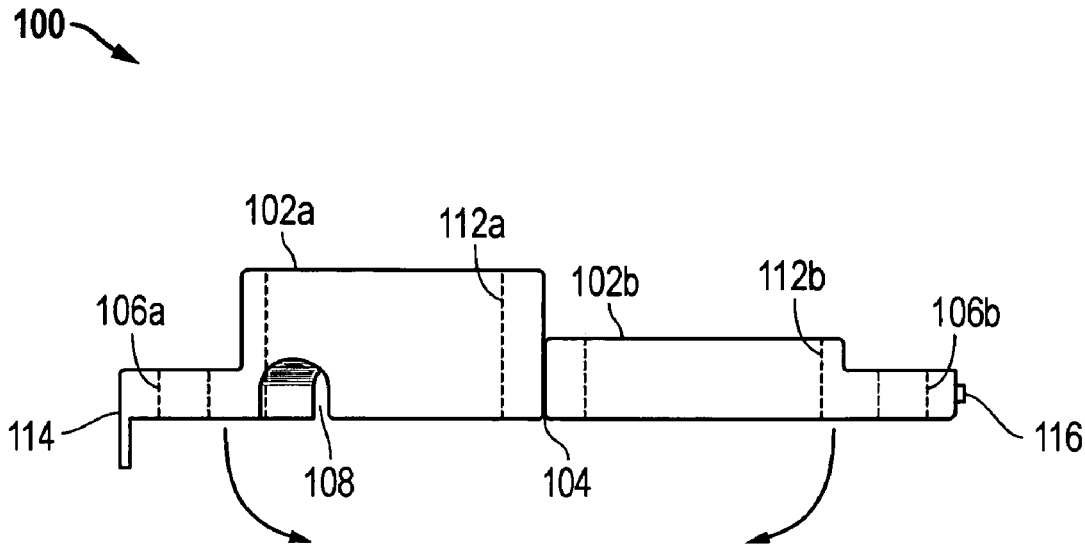
FIG. 2 is a top view of a securement housing configured according to one exemplary embodiment of the disclosed apparatus and methods.
Figure 3:
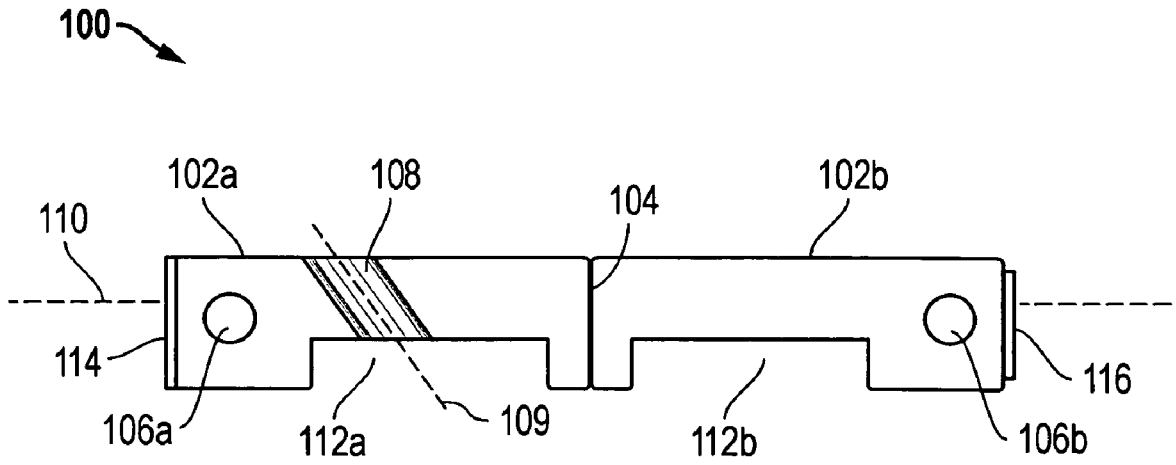
FIG. 3 is a side view of a securement housing configured according to one exemplary embodiment of the disclosed apparatus and methods.

FIG. 2 shows a top view of securement housing 100 of FIG. 1A. Optional first and second internal base cavities 112*a* and 112*b* and optional apertures 106*a* and 106*b* are shown in dashed outline in FIG. 2. FIG. 3 shows a side view of securement housing of FIG. 1A.

Figure 4:
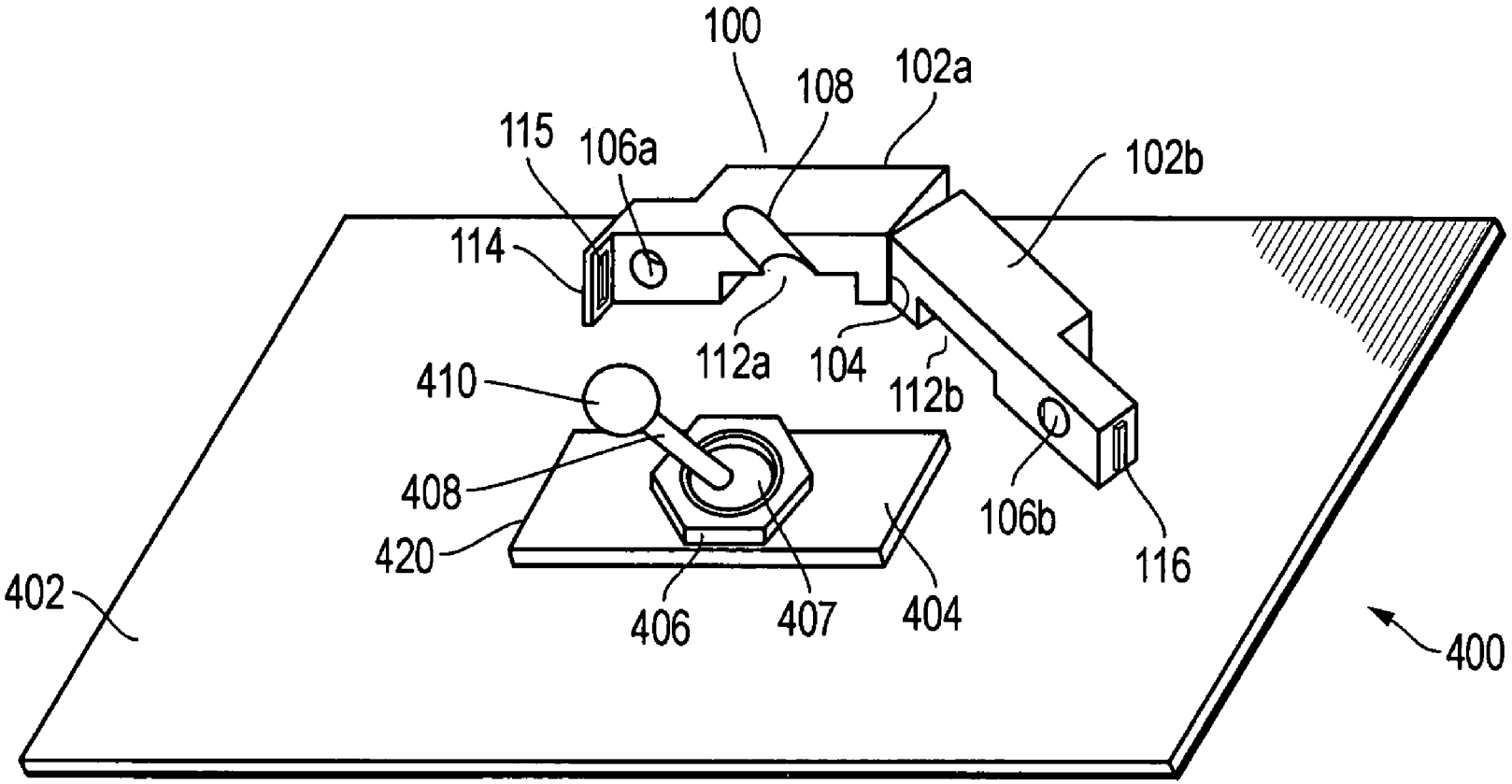
FIG. 4 is a perspective view of a circuit breaker toggle switch and securement housing that is configured according to one exemplary embodiment of the disclosed apparatus and methods.

FIG. 4 is a perspective view of a circuit breaker toggle switch assembly 400 and securement housing 100 that is configured according to one exemplary embodiment of the disclosed apparatus and methods. As shown, toggle switch assembly 400 of this exemplary embodiment includes a two-position toggle switch device 420 (e.g., a MS24509 circuit breaker toggle switch) that is installed within a switch mounting component 402 which may be, for example, a circuit panel, switch panel, instrument panel, etc. In the illustrated embodiment, a circuit breaker identification plate 404 and threaded nut and collar 406 are provided that secure toggle switch device 420 to mounting surface 402 through an opening provided therein, and a toggle mechanism 407 about which switch arm 408 toggles. Toggle switch device 420 includes a cylindrical-shaped switch arm 408 with a spherical-shaped switch head 410 disposed on the end thereof. Switch arm 408 of toggle switch device 420 is shown in FIG. 1A disposed in one of its two possible positions, which for purposes of example may be considered an "off" position of toggle switch device 420 although the disclosed apparatus and methods may be employed to lockout a toggle switch device in an "on" position, or in any other desired switch position.

It should be noted that when employed with a MS24509 toggle switch circuit breaker device that the angle of the switch arm relative to the switch base when in the "off" position (e.g., about 56 degrees) is different than the angle of the switch arm relative to the switch base when in the "on" position. For such cases where a switch arm is angled differently relative to the switch base when placed in different switch positions, a pocketed groove may be configured so that it can only be installed to secure the switch arm in one of the angled positions (e.g., so that it can only be installed on a MS24509 circuit breaker when the switch arm is in its 56 degree angled "off" position). Such a characteristic may be particularly desirable as a safety feature for lockout purposes where it is important that the circuit breaker be secured in the "off" position.

In FIG. 4, securement housing 100 is shown disposed adjacent toggle switch 400 with first and second side section components 102*a* and 102*b* of securement housing 100 shown partially rotated toward each other around hinge line 104. As illustrated in FIG. 4, securement housing 100 is shown in a position so that pocketed groove 108 of side section component 102*a* is oriented for accepting switch arm 408 when the switch arm is in its illustrated (e.g., "off") position.

Figure 5:
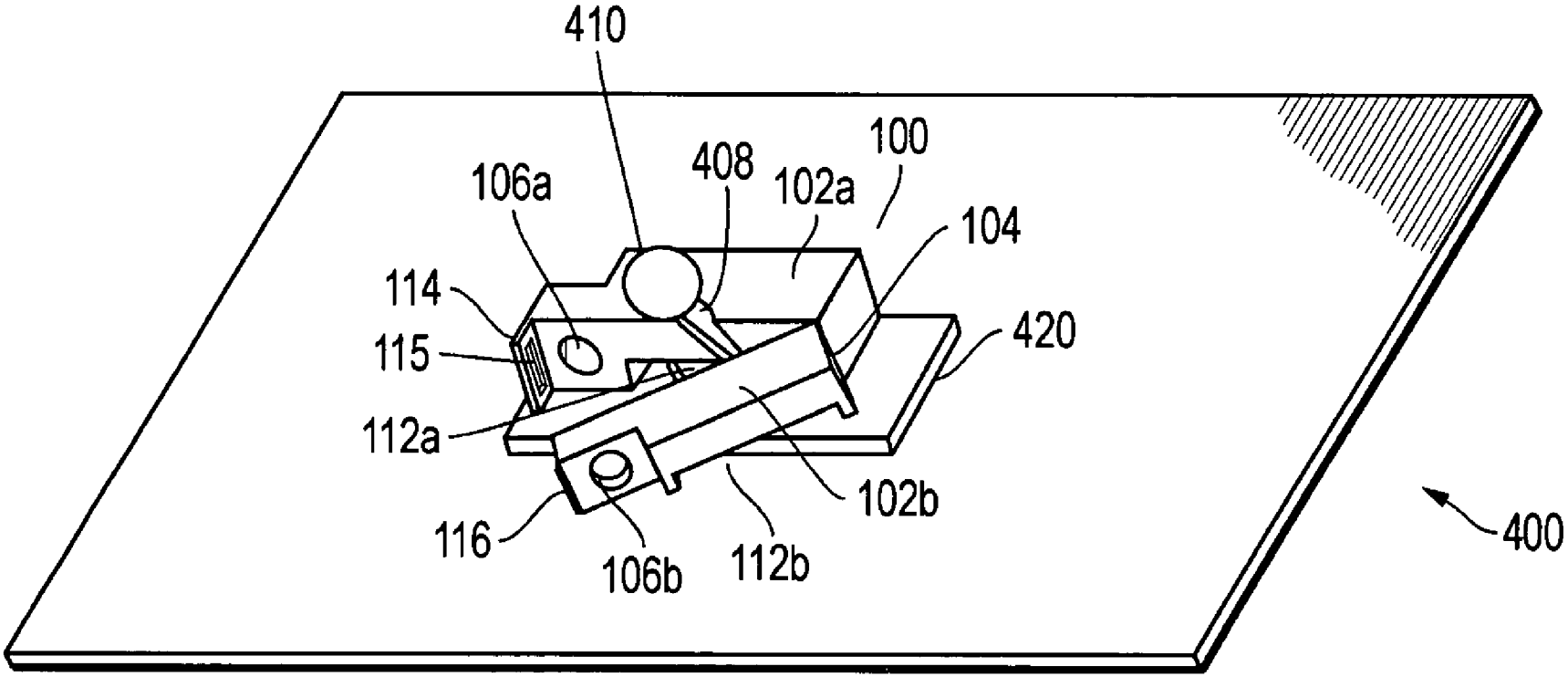
FIG. 5 is a perspective view of a circuit breaker toggle switch and securement housing that is configured according to one exemplary embodiment of the disclosed apparatus and methods.

FIG. 5 shows securement housing 100 in a partially-installed position relative to toggle switch device 420 of FIG. 4. In FIG. 5, securement housing 100 is shown positioned so that pocketed groove 108 of side section component 102*a* accepts switch arm 408 of FIG. 4. FIG. 5 also shows side section component 102*b* further rotated toward side section component 102*a* around hinge line 104.

Figure 6:
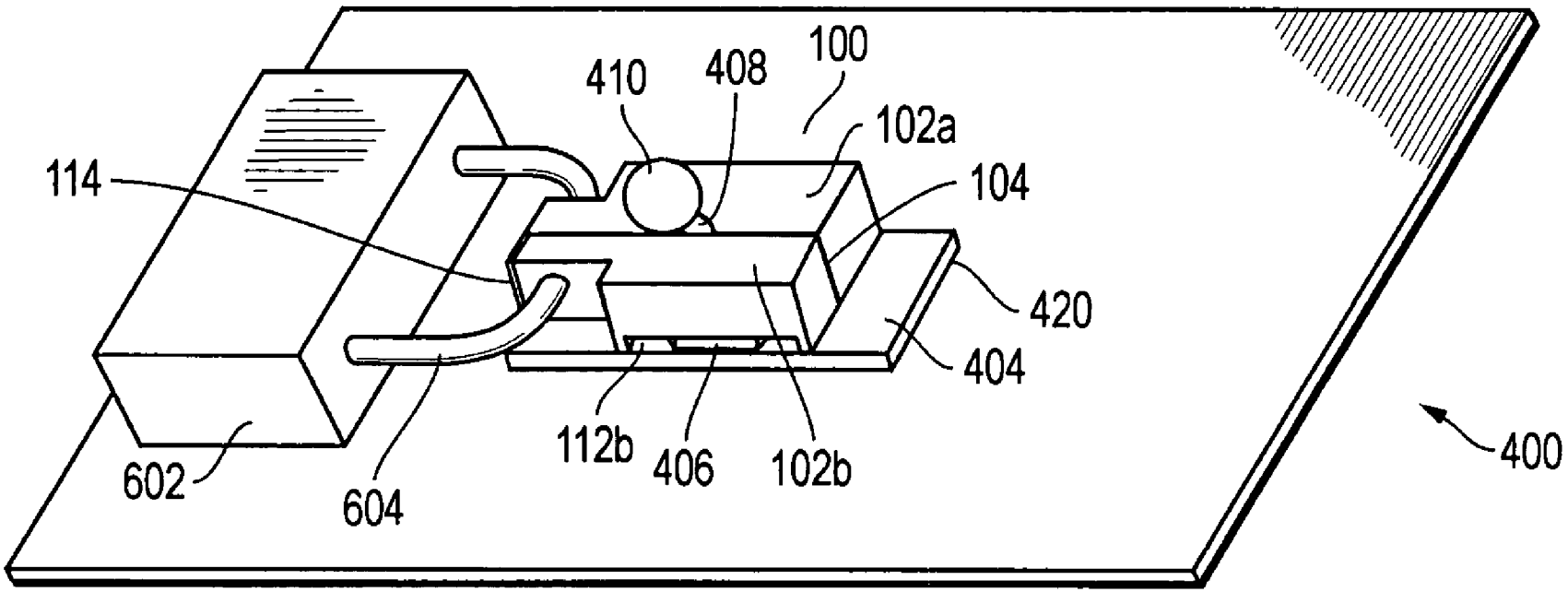
FIG. 6 is a perspective view of a securement housing closed around a circuit breaker toggle switch according to one exemplary embodiment of the disclosed apparatus and methods.

FIG. 6 is a perspective view showing securement housing 100 installed in position to lockout toggle switch device 420 of FIG. 4 in the "off" position. As shown in FIG. 6, first and second side section components 102*a* and 102*b* of securement housing 100 are closed around switch arm 408 to capture switch arm 408 within pocketed groove 108 between switch head 410 and switch base 404 with switch head 410 disposed in a position outside pocketed groove 108 and the rest of securement housing 100. As further shown, first and second internal base cavities 112*a* and 112*b* are brought together to accept toggle mechanism 407 and threaded nut and collar 406 of toggle switch device 420 in a manner such that the underside of first and second side section components 102*a* and 102*b* are allowed to make contact with circuit breaker identification plate 404. When installed in this position on toggle switch device 420, movement of switch arm 408 from "off" position to "on" position is prevented within pocketed groove 108 due to contact between the underside of closed securement housing 100 with circuit breaker identification plate 404, and due to contact between the upper side of securement housing 100 with switch head 410.

As further shown in FIG. 6, first and second side section components 102*a* and 102*b* are latched together around switch arm 408 by virtue of latch tab member 116 being received and mechanically engaged by latch receptacle member 114 in a manner as described elsewhere herein. Further shown in FIG. 6 is a locking device 602 provided in the form of a padlock (e.g., combination or keyed) having a shackle 604 that is received through assembled mating apertures 106*a* and 106*b* to lock first and second side section components 102*a* and 102*b* of securement housing 100 around switch arm 408 by preventing first and second side section components 102*a* and 102*b* from being separated from each other until shackle 604 is removed. As previously described, any other form of locking or fastening device (e.g., lockout pin, lockout seal, lockout tag, etc.) may be additionally or alternatively installed through mating apertures 106*a* and 106*b*.

Figure 7:
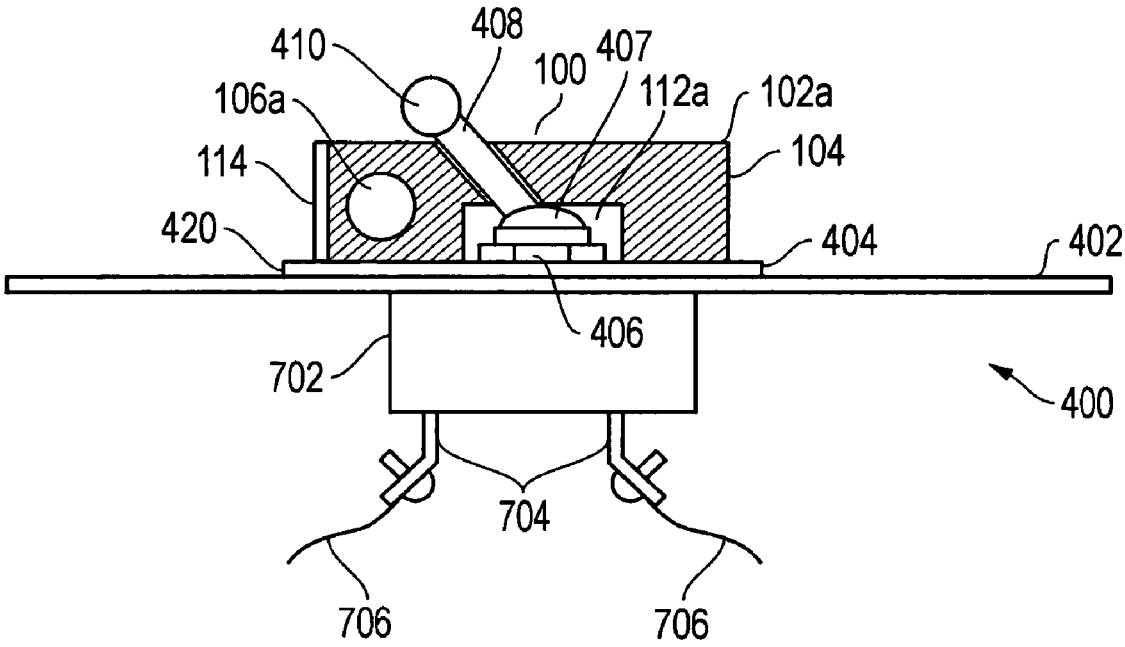
FIG. 7 is a side cross-sectional view of a securement housing closed around a circuit breaker toggle switch according to one exemplary embodiment of the disclosed apparatus and methods.

FIG. 7 shows a cross-sectional side view of securement housing 100 assembled to toggle switch device 420 of circuit breaker toggle switch assembly 400 of FIG. 6. In this regard, FIG. 7 further shows how switch arm 408 is captured within pocketed groove 108 between switch head 410 and switch base 404. As shown, pocketed groove 108 is open at opposing ends (upper and lower ends) of the groove to accept switch arm 408 in a manner so that switch arm 408 passes through each of the opposing ends and so that switch head 410 is disposed above securement housing 100. FIG. 7 also shows how toggle mechanism 407 and threaded nut and collar 406 are accepted within internal base cavity 112*a* of first side section component 102*a*. As shown, the underside of first section 102*a* makes contact with base surface 404 of toggle switch assembly 400 so that securement housing 100 is secured in sandwich manner between switch head 410 and base surface 404 in a manner that prevents its removal. Consequently, movement of switch arm 408 from "off" position to "on" position is prevented by contact between switch arm 408 and pocketed groove 108 that surrounds switch arm 408.

When in such a closed lockout position, it will be understood that securement housing 100 need not be dimensioned so as to entirely capture the full length of switch arm 408 in a manner that holds or sandwiches securement housing 100 in firm simultaneous contact with switch head 410 and base surface 404 of toggle switch assembly 400, and/or pocketed groove 108 need not be dimensioned to tightly surround the outer dimensions of switch arm 408, so that switch arm 408 is incapable of any motion. Rather, securement housing 100 needs only be dimensioned to capture a sufficient portion of the length of switch arm 408, and/or pocketed groove 108 need only be dimensioned to surround the outer dimensions of switch arm 408 sufficiently closely, so that switch arm 408 cannot be moved from the "off" to "on" position due to contact with switch head 410 and base surface 404 of toggle switch assembly 400. However, it may be desirable in one embodiment to configure securement housing 100 so that that it captures substantially the full length of switch arm 408 and/or otherwise captures at least a portion of switch arm 408 in a manner that holds or sandwiches securement housing 100 in firm simultaneous contact with switch head 410 and base surface 404 of toggle switch assembly 400. Additionally or alternatively, pocketed groove 108 may be dimensioned in one embodiment so that inner surface of pocketed groove 108 surrounds and contacts the outer dimensions of switch arm 408, e.g., in a substantially tight fitting relationship with the switch arm.

Also shown in FIG. 7 are toggle switch components that may be present behind mounting surface 402 (e.g., circuit panel face, switch panel face, instrument panel face, etc.) of the illustrated embodiment. These toggle switch components include switch housing 702 that contains the electrical components of toggle switch assembly 400, and switch terminals 704 for electrically coupling these electrical components to other circuitry using electrical conductors 706.

It will be understood that the securement housing configuration illustrated in FIGS. 1-7 is exemplary only, and that the disclosed apparatus and methods may be implemented with any other configuration suitable for providing a securement housing that is suitable for positioning around a switch arm of a toggle switch, in order to capture the switch arm between the switch head and base surface of a toggle switch assembly 400. In this regard, the disclosed apparatus and methods may be configured with one or more internal profiles suitable for accepting switch arms of varying diameter and shape, e.g., including non-cylindrical-shaped switch arm profiles. Such internal profiles may be provided as a single internal profile defined within only one side section component of a securement housing as illustrated herein (e.g., configured with internal dimensions suitable for accepting the entire outer periphery of a switch arm), or may alternatively be provided as two complementary profiles (e.g., a first profile defined within a first side section component and a second mating profile defined within a second side section component that are capable of mating together to accept the entire outer periphery of a switch arm). For example, each of first side section component 102*a* and second side section component 102*b* may be provided with an internal pocketed groove configured with a half-cylinder shape that are oriented to mate around the outer periphery of a switch arm in a manner that captures the switch arm between the switch head and base surface of a toggle switch assembly when side section components 102*a* and 102*b* are closed around the switch arm.

In the practice of the disclosed apparatus and methods a securement housing may be also be configured with more than two separate component sections that may be brought together to capture a switch arm within an internal profile defined therein, and/or may be configured to capture a switch arm within an internal profile by coming together (with or without a hinge mechanism/s) around the switch arm in manner other than as illustrated for side section components 102*a* and 102*b* of securement housing 100 illustrated herein which come together in a plane perpendicular to the plane of the switch arm motion. In this regard, two or more side section components of a securement housing may come together in a plane other than a plane perpendicular to the plane of the switch arm motion. Furthermore, a securement housing may be configured with a single component section having an internal profile dimensioned and oriented to conform to and accept at least a portion of the outer dimensions of switch arm and to be held in place with the switch arm by a pin or other fastening or locking device, or any other suitable securing component. For example, a securement housing may be alternatively provided only with side section component 102*a* of the Figures herein (i.e., without side section component 102*b*) but instead with attachment locations (e.g., eyelets) on the surface of side section component 102*a* that is open to the internal profile for insertion or attachment of a pin or other device (or alternatively for attachment of adhesive tape) for preventing removal of the switch arm from engagement with the internal profile of the side section component.

Figure 8A:
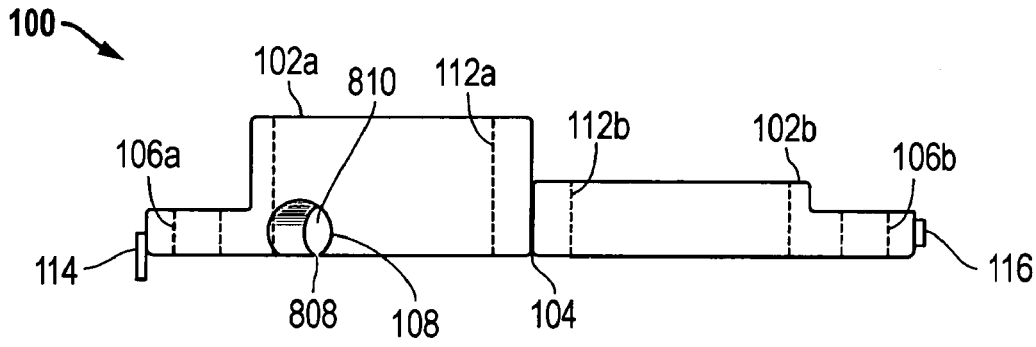
FIG. 8A is a top view of a securement housing configured according to one exemplary embodiment of the disclosed apparatus and methods.
Figure 8B:
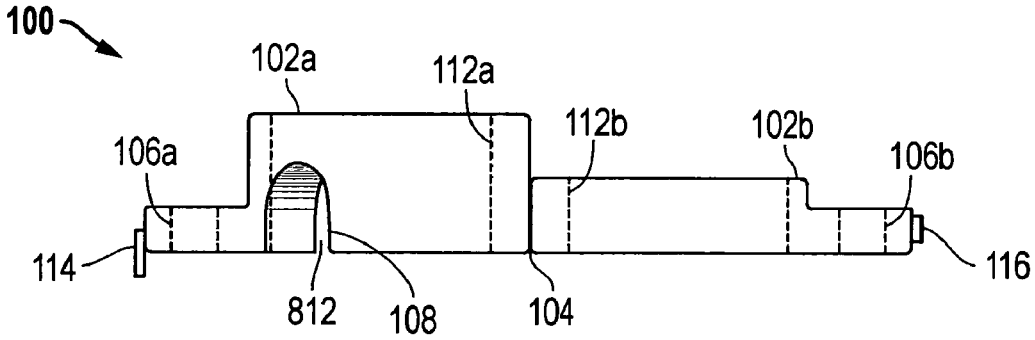
FIG. 8B is a top view of a securement housing configured according to one exemplary embodiment of the disclosed apparatus and methods.

FIGS. 8A through 8D illustrate alternative embodiments of the disclosed apparatus and methods. FIG. 8A shows a securement housing 100 configured with a narrowed internal profile 108 having a narrowed throat opening 808 that is narrower than the outer dimensions of a switch arm in combination with an enlarged inner open portion 810 having dimensions large enough to accept the entire outer dimension of the switch arm without deflection or with less deflection than the narrowed throat opening. As previously described, such an inner profile configuration may be implemented to provide a "snap-on" fit around a switch arm. FIG. 8B shows a securement housing 100 configured with an elongated narrowed internal profile 108 having an elongated open inner portion that is narrower than the outer dimensions of a switch arm. Such an elongated narrowed inner profile configuration may be implemented to receive the switch arm in resilient and frictional engagement. It will be understood that an internal profile may be provided in a variety of other shapes, and/or that any portion of an internal profile may be narrowed, as may be suitable for engaging a switch arm to secure the switch arm in a manner as described elsewhere herein.

Figure 8C:
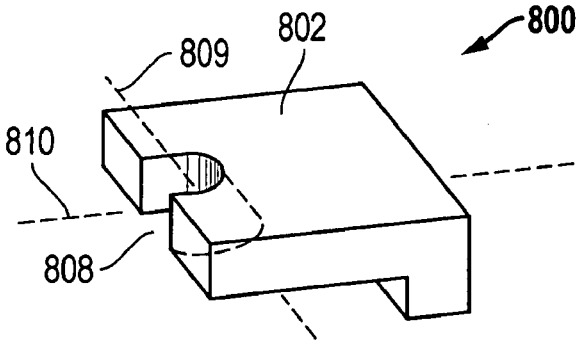
FIG. 8C is a perspective top view of a securement housing configured according to one exemplary embodiment of the disclosed apparatus and methods.
Figure 8D:
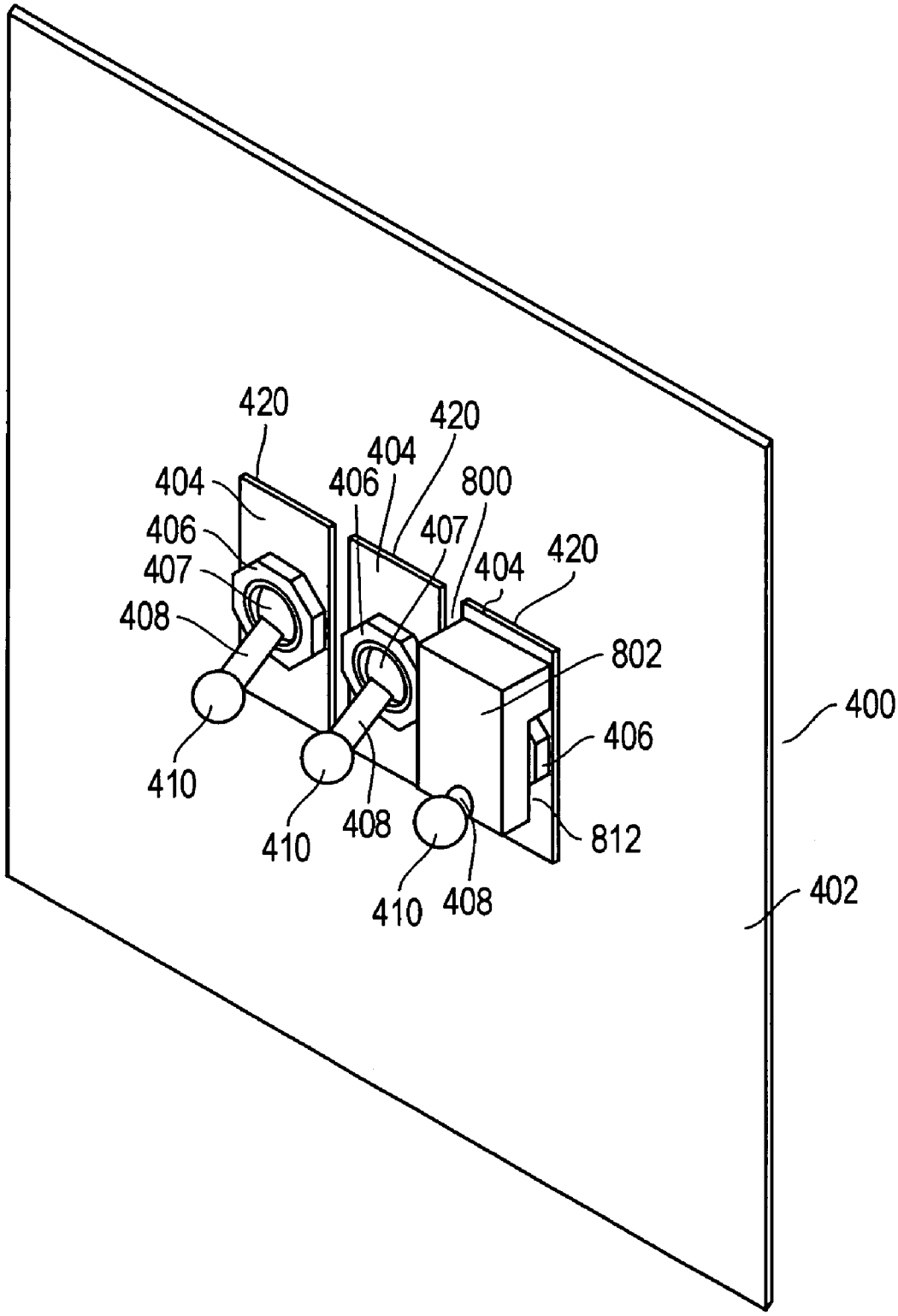
FIG. 8D is a perspective view of a securement housing and circuit breaker toggle switch according to one exemplary embodiment of the disclosed apparatus and methods.

FIG. 8C illustrates a securement housing 800 configured as a single component housing 802 (i.e., configured as a securement housing having only one housing component and with no mating side section component or other housing component) that has an internal profile 108 (that may be a pocketed groove such as described elsewhere herein) in combination with an internal base cavity portion 812. In this embodiment, pocketed groove 108 is shown in dashed outline to be configured with an internal surface, at least a portion of which is oriented at an angle relative to the longitudinal axis 810 of housing component 802 so as to define a longitudinal axis 809 of pocketed groove 108. In this embodiment, at least a portion of the internal surface of pocketed groove 108, and the longitudinal axis 809 defined thereby, are oriented at an angle that corresponds to, or is substantially the same as, the angle of a cylindrical switch arm relative to a switch base of a toggle switch when the switch arm is in its "off" position. FIG. 8D shows securement housing 800 installed in position to lockout toggle switch device 420 of FIG. 8D in the "off" position. As shown in FIG. 8D, switch arm 408 is captured within pocketed groove 108 of single housing component 802 of securement housing 800 between switch head 410 and switch base 404 with switch head 410 disposed in a position outside pocketed groove 108 and the rest of securement housing 100. In one exemplary embodiment, pocketed groove 108 of FIGS. 8C and 8D may be configured with a narrowed profile (e.g., narrowed throat opening 808 of FIG. 8A or elongated narrowed opening 812 of FIG. 8B) in order to more securely engage single component 802 of housing 800 with switch arm 408 of switch device 420.

As further shown, internal base cavities 812 partially surrounds and accepts toggle mechanism 407 and threaded nut and collar 406 of toggle switch device 420 in a manner such that the underside of housing component 802 is allowed to make contact with circuit breaker identification plate 404. When installed in this position on toggle switch device 420, movement of switch arm 408 from "off" position to "on" position is prevented within pocketed groove 108 due to contact between the underside of securement housing 800 with circuit breaker identification plate 404, and due to contact between the upper side of securement housing 800 with switch head 410 and/or contact between internal surfaces of pocketed groove 108 and outer surfaces of switch arm 108.

It will be further understood that the disclosed apparatus and methods may be implemented with lockout toggle switches having a variety of different configurations. Thus, it will be understood that the MS24509 circuit breaker toggle switch is just one example configuration with which a securement housing may be implemented using the disclosed apparatus and methods. Thus, the spherical-shaped switch head (e.g., of a MS24509 circuit breaker toggle switch) is exemplary only, and a securement housing of the disclosed apparatus and methods may be implemented with toggle switches having any other switch head configurations that are suitable for acting as captivating switch heads, i.e., any switch head coupled to a corresponding switch arm and that has a configuration that prevents an internal profile of a securement housing from being removed from engagement with the corresponding switch arm in a direction over the switch head. Examples of suitable captivating switch heads include any switch head having a shape enlarged relative to the cross sectional area of the switch arm (e.g., bulbous relative to the cross sectional area of the switch arm, flat and nail head-like relative to the cross sectional area of the switch arm, etc.), a shape offset relative to the longitudinal axis of the switch arm, or in any other configuration that extends beyond a longitudinal extension of the outer cross-sectional area of the switch arm at the point where the switch arm couples to the switch head.

It will also be understood that internal profiles of the disclosed apparatus and methods may be configured to capture a switch arm of a toggle switch that is positioned at angles greater than or lesser than about 56 degrees relative to the switch base. Additionally, the disclosed apparatus and methods may be implemented to capture and hold a toggle switch in any position as may be desired or needed to fit the requirements of a given application including a position that does not correspond to an "off" position. For example, in one alternative application a securement housing may be employed to capture and lock the switch arm of a two-way on/off toggle switch in the "on" position rather than the "off" position. In another example application, a securement housing may be employed to capture and lock the switch arm of a three (or more)-way toggle switch in any given one of the possible positions of the switch arm. In yet another example application, a securement housing may be employed to capture and lock the switch arm of a multi-position toggle switch between positions of the toggle switch.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed apparatus and methods may be utilized in various combinations and/or independently. Thus the invention is not limited to only those combinations shown herein, but rather may include other combinations.

What is claimed is:

1. A switch securement apparatus configured for use with a toggle switch having a switch arm and a switch head, said apparatus comprising a securement housing having an internal profile defined therein, said internal profile being configured to capture at least a portion of said switch arm of said toggle switch with at least a portion of said switch head of said toggle switch being disposed outside said securement housing; wherein said internal profile is configured so that said switch head of said toggle switch acts as a captivating switch head that prevents said internal profile of said securement housing from being removed from engagement with said switch arm in a direction over said switch head when said securement housing is assembled to said toggle switch in a manner so that said internal profile captures at least a portion of said switch arm of said toggle switch.

2. The apparatus of claim 1, wherein said toggle switch comprises a part of a toggle switch assembly, and wherein said internal profile of said securement housing is configured to capture at least a portion of said switch arm of said toggle switch between said switch head and an adjacent surface so that said internal profile prevents movement of said switch arm from a first switch position to a second switch position.

3. The apparatus of claim 1, wherein said securement housing comprises a first side section component having said internal profile defined therein; and wherein said internal profile comprises a pocketed groove that is dimensioned and oriented to conform to and accept at least a portion of said switch arm when said first side section component is assembled to said toggle switch in a manner so that said internal profile captures at least a portion of said switch arm of said toggle switch.

4. The apparatus of claim 3, wherein said switch arm has an angle relative to a base surface of a toggle switch assembly when said switch arm is disposed in said first position;

wherein said pocketed groove has a longitudinal axis that is oriented within said first side section component at an angle relative to said base surface of said toggle switch assembly that is substantially the same as said angle of said switch arm in said first position when said first side section component is assembled to said toggle switch in a manner so that said internal profile captures at least a portion of said switch arm of said toggle switch; wherein said pocketed groove is internally dimensioned so as to be large enough to conform to and accept the outer dimensions of said switch arm; and wherein said pocketed groove is internally dimensioned to be smaller than the outer dimensions of said switch head.

5. The apparatus of claim 3, wherein said securement housing comprises a second side section component configured to be brought together with said first side section component around said switch arm.

6. The apparatus of claim 5, wherein a first end of said first side section component and a first end of said second side section component are coupled together by a hinge mechanism; and wherein a second end of said first side section component and a second end of said second side section component are configured to be brought together by rotation about said hinge mechanism around said switch arm.

7. The apparatus of claim 6, wherein said securement housing comprises a single piece of injection molded plastic that includes said first side section, said second side section and said hinge mechanism; and wherein said hinge mechanism comprising a living hinge.

8. The apparatus of claim 6, further comprising complementary latch feature components disposed on each of said first and said second side section components to latch said first and second section components together around said switch arm.

9. The apparatus of claim 6, further comprising a first aperture defined in said first side section component; a second aperture defined in said second side section component; wherein said first and second apertures are configured to be aligned to form a fastening point for a fastening device when said first and second side sections are closed together around said switch arm.

10. The apparatus of claim 1, wherein at least a portion of said internal profile is configured with dimensions narrower than the outer diameter of said switch arm to resiliently engage at least a portion of said switch arm, frictionally engage at least a portion of said switch arm, or a combination thereof.

11. The apparatus of claim 1, further comprising an internal base cavity defined in said securement housing, said internal base cavity being configured to accept a toggle mechanism of said toggle switch.

12. The apparatus of claim 1, wherein said switch arm of said toggle switch has a cylindrical shape.

13. A switch securement apparatus configured for use with a toggle switch having a switch arm and a switch head, said apparatus comprising a securement housing having an internal profile defined therein, said internal profile being configured to capture at least a portion of said switch arm of said toggle switch with at least a portion of said switch head of said toggle switch being disposed outside said securement housing; wherein said securement housing is a single component housing having no mating side section component and having said internal profile defined therein; and wherein said internal profile of said single component housing is configured to capture at least a portion of said switch arm of said toggle switch between said switch head and an adjacent surface so that said internal profile prevents movement of said switch arm from a first switch position to a second switch position.

14. The apparatus of claim 1, wherein said securement housing comprises:

a first side section component having said internal profile defined therein, said internal profile comprising a pocketed groove, and said pocketed groove being open at opposing ends; and a second side section component hingeably coupled to said first side section component.

15. The apparatus of claim 14, wherein a first end of said first side section component and a first end of said second side section component are coupled together by a hinge mechanism; and wherein a second end of said first side section component and a second end of said second side section component are configured to be brought together by rotation about said hinge mechanism.

16. The apparatus of claim 14, wherein said securement housing comprises a single piece of injection molded plastic that includes said first and second side sections; and wherein said first and second side sections are hingeably coupled together by a living hinge.

17. The apparatus of claim 16, wherein said pocketed groove has a longitudinal axis that is oriented at an angle relative to a longitudinal axis of said first side section component.

18. The apparatus of claim 14, further comprising complementary latch feature components disposed on each of said first and said second side section components to latch said first and second section components together.

19. The apparatus of claim 18, further comprising a first aperture defined in said first side section component; a second aperture defined in said second side section component;

wherein said first and second apertures are configured to be aligned to form a fastening point for a fastening device when said second ends of said first and second side sections are brought together.

20. The apparatus of claim 14, wherein said pocketed groove comprises a narrowed throat opening and an enlarged inner open portion, or an elongated open inner portion.

21. The apparatus of claim 14, further comprising an internal base cavity defined in each of said first and second side section components.

22. The apparatus of claim 14, wherein said switch arm of said toggle switch has a cylindrical shape.

23. A switch securement apparatus configured for use with a toggle switch having a switch arm and a switch head, said apparatus comprising a securement housing having an internal profile defined therein, said internal profile being configured to capture at least a portion of said switch arm of said toggle switch with at least a portion of said switch head of said toggle switch being disposed outside said securement housing; wherein said securement housing comprises a first side section component having said internal profile defined therein; and wherein said internal profile comprises a pocketed groove that is dimensioned and oriented to conform to and accept at least a portion of said switch arm when said first side section component is assembled to said toggle switch in a manner so that said internal profile captures at least a portion of said switch arm of said toggle switch; and wherein said switch arm has an angle relative to a base surface of a toggle switch assembly when said switch arm is disposed in said first position; wherein said pocketed groove has a longitudinal axis that is oriented within said first side section component at an angle relative to said base surface of said toggle switch assembly that is substantially the same as said angle of said switch arm in said first position when said first side section component is assembled to said toggle switch in a manner so that said internal profile captures at least a portion of said switch arm of said toggle switch;

wherein said pocketed groove is internally dimensioned so as to be large enough to conform to and accept the outer dimensions of said switch arm; and wherein said pocketed groove is internally dimensioned to be smaller than the outer dimensions of said switch head.

24. A switch securement apparatus configured for use with a toggle switch having a switch arm and a switch head, said apparatus comprising a securement housing having an internal profile defined therein, said internal profile being configured to capture at least a portion of said switch arm of said toggle switch with at least a portion of said switch head of said toggle switch being disposed outside said securement housing; wherein said securement housing comprises a first side section component having said internal profile defined therein; and wherein said internal profile comprises a pocketed groove that is dimensioned and oriented to conform to and accept at least a portion of said switch arm when said first side section component is assembled to said toggle switch in a manner so that said internal profile captures at least a portion of said switch arm of said toggle switch; wherein said securement housing comprises a second side section component configured to be brought together with said first side section component around said switch arm; wherein a first end of said first side section component and a first end of said second side section component are coupled together by a hinge mechanism; and wherein a second end of said first side section component and a second end of said second side section component are configured to be brought together by rotation about said hinge mechanism around said switch arm.

25. The apparatus of claim 24, wherein said securement housing comprises a single piece of injection molded plastic that includes said first side section, said second side section and said hinge mechanism; and wherein said hinge mechanism comprising a living hinge.

26. The apparatus of claim 24, further comprising complementary latch feature components disposed on each of said first and said second side section components to latch said first and second section components together around said switch arm.

27. The apparatus of claim 24, further comprising a first aperture defined in said first side section component; a second aperture defined in said second side section component; wherein said first and second apertures are configured to be aligned to form a fastening point for a fastening device when said first and second side sections are closed together around said switch arm.

28. A switch securement apparatus configured for use with a toggle switch having a switch arm and a switch head, said apparatus comprising a securement housing having an internal profile defined therein, said internal profile being configured to capture at least a portion of said switch arm of said toggle switch with at least a portion of said switch head of said toggle switch being disposed outside said securement housing; wherein at least a portion of said internal profile is configured with dimensions narrower than the outer diameter of said switch arm to resiliently engage at least a portion of said switch arm, frictionally engage at least a portion of said switch arm, or a combination thereof.

* * * * *